US008878090B2

(12) United States Patent
Vladimirov et al.

(10) Patent No.: US 8,878,090 B2
(45) **Date of Patent: *Nov. 4, 2014**

(54) METHOD FOR SEPARATING MINERALS ACCORDING TO THE LUMINESCENT PROPERTIES THEREOF

(75) Inventors: Evgeny Nikolaevich Vladimirov, Saint-Petersburg (RU); Leonid Vasilievich Kazakov, Saint-Petersburg (RU); Vladimir Iosifovich Tsvetkov, Saint-Petersburg (RU)

(73) Assignee: Research and Production Enterprise "Bourevestnik", St. Petersburg (RU)

( * ) Notice: Subject to any disclaimer, the term of this patent is extended or adjusted under 35 U.S.C. 154(b) by 0 days.

This patent is subject to a terminal disclaimer.

(21) Appl. No.: 13/637,268

(22) PCT Filed: Nov. 8, 2011

(86) PCT No.: PCT/RU2011/000876
§ 371 (c)(1),
(2), (4) Date: Sep. 25, 2012

(87) PCT Pub. No.: WO2012/067542
PCT Pub. Date: May 24, 2012

(65) Prior Publication Data

US 2013/0126400 A1 May 23, 2013

(30) Foreign Application Priority Data

Nov. 19, 2010 (RU) ..... 2010148487

(51) Int. Cl.
*B07C 5/346* (2006.01)
*B07C 5/342* (2006.01)
*B07C 5/34* (2006.01)

(52) U.S. Cl.
CPC . *B07C 5/34* (2013.01); *B07C 5/342* (2013.01); *B07C 5/346* (2013.01)
USPC ..... 209/589; 378/45

(58) Field of Classification Search
USPC ..... 209/576, 577, 580–582, 589, 44.2, 639; 378/45
See application file for complete search history.

(56) References Cited

U.S. PATENT DOCUMENTS 4,848,590 A * 7/1989 Kelly ..... 209/564
7,763,820 B1 * 7/2010 Sommer et al. ..... 209/576
2009/0261024 A1 * 10/2009 Sommer et al. ..... 209/589

FOREIGN PATENT DOCUMENTS

GB 2022824 12/1979
GB 2022824 A 12/1979

(Continued)

OTHER PUBLICATIONS

All office actions including decision to grant for RU application which forms basis of PPH request and English translations thereof.

(Continued)

*Primary Examiner* — Joseph C Rodriguez
*Assistant Examiner* — Kalyanavenkateshware Kumar
(74) *Attorney, Agent, or Firm* — Garcia Zamor IP Law; Ruy M. Garcia-Zamor

(57) ABSTRACT

The method relates to the field of mineral enrichment. It involves establishing threshold values of the intensity of a luminescence signal arising during the action of a pulse of exciting radiation on a material being separated and after a specified time following the end of the exciting pulse, and, during the processing of the recorded signal, first of all determining the value of the intensity of the luminescence signal, comparing the value obtained with the specified threshold value and, in the event of the threshold value being exceeded, processing the signal in order to determine the value of the selected separation criterion, comparing the processing result with the specified threshold value and isolating the mineral to be enriched from the material being separated if the comparison result satisfies the specified criterion; in the event of the value of the intensity of the luminescence signal after a specified time following the end of the exciting pulse being less than the threshold value thereof, determining the value of the intensity of the luminescence signal arising during the pulse of exciting radiation, comparing said value with the threshold value specified therefor and isolating the mineral to be enriched from the material being separated if the threshold value is exceeded.

3 Claims, 2 Drawing Sheets

(56) References Cited

FOREIGN PATENT DOCUMENTS

| | | |
|---|---|---|
| GB | 2310927 A | 9/1997 |
| RU | 2170628 | 7/2001 |
| RU | 2196013 | 1/2003 |
| RU | 2235599 | 9/2004 |
| RU | 2236914 | 9/2004 |
| RU | 2249490 | 4/2005 |
| RU | 2355483 | 5/2009 |
| RU | 2362635 | 7/2009 |
| SU | 1459014 | 9/1995 |

OTHER PUBLICATIONS

Translation of Russian Written Opinion; Russian Written Opinion; and Russian International Search Report for PCT/RU2011/000876, Nov. 2011.

Publication for PCT/RU2011/000876, Nov. 2011.

* cited by examiner

METHOD FOR SEPARATING MINERALS ACCORDING TO THE LUMINESCENT PROPERTIES THEREOF

CROSS REFERENCE TO RELATED APPLICATIONS

This application claims priority to the following patent applications: (1) Patent Cooperation Treaty Application PCT/RU2011/000876 filed Nov. 8, 2011; and (2) Russian Application No. 2010148487 filed Nov. 19, 2010; each of the above cited applications is hereby incorporated by reference herein as if fully set forth in its entirety.

THE FIELD OF TECHNOLOGY

This invention belongs to the field of mineral dressing, and, more specifically, to methods for the segregation of crushed mineral matter containing minerals that become fluorescent under effect of excitation radiation into concentrating product and tailings. The proposed method can be implemented both for X-ray fluorescent separators at every beneficiation stage, and in product controllers, for diamond-bearing raw matter, for example.

PRIOR ART

The mineral fluorescence signal recorded for a certain period of time generally contains:

- a short-lived or fast fluorescence component (further—FC) that occurs virtually simultaneously (at an interval of several microseconds) when the excitation radiation effect starts and disappears immediately after the end that effect;
- a long-lived or slow fluorescent component (further—SC) the intensity of which continuously increases during the excitation radiation effect and decays relatively slowly (between hundreds of microseconds and milliseconds) after it ends (fluorescence afterglow period).

The real fluorescence signal can be considered a superposition or overlapping of the above components.

The known separators are Flow Sort CDX-116VE machines to concentrate diamond-bearing material, where the mineral material placed in the preset trajectory of its movement is continuously affected by the excitation radiation; and the sorting criteria is the total (integral) intensity of the FC and SC of mineral fluorescence signal recorded during action of excitation radiation [http://www.flow.co.za/write-ups/NEW_RECOVERY_MACHINE.pdf].

This method of mineral segregation can detect all kinds of diamonds, including group II diamonds, where the fluorescent signal virtually has no SC.

However, this method of mineral segregation has low recovery selectivity of concentrating mineral, which is dictated by the inability to identify the fluorescent signal of diamonds among the same of some associated minerals that also have intensive FC (zircons, feldspars, etc.).

In order to enhance the recovery selectivity of the concentrating mineral, the known method uses such segregation criterion as various combinations of kinetic characteristics of the fluorescence signal recorded both during and after (afterglow period) the action of excitation radiation on the mineral material.

For example, there is a known method for mineral segregation consisting of mineral fluorescence excitation, measurement of SC afterglow intensity, determination of its change rate at the preset interval of measurement time that dictates the mineral segregation [SU 1459014, A1, B03B 13/06, 1995]. In this method, the fluorescence signal SC decay rate is chosen as the criterion for the separation of concentrating and associated fluorescent minerals.

This method has two disadvantages:

- it does not ensure selectivity against associated minerals with high fluorescence intensity and relatively short SC;
- it is not suitable for the detection of minerals with very low (at the instrumentation hardware noise level) or missing intensity of fluorescence SC.

Another known separation method for diamond-bearing materials, consisting of excitation of fluorescence by pulsed X-ray radiation of a duration sufficient to induce the long fluorescence component, determination of the total intensity of short and long fluorescence components during the X-ray radiation pulse action, determination of the intensity of the long fluorescence component, after the end of the X-radiation pulse action, determination of the concentration criterion value by ratio of the total intensity of short and long fluorescence components versus the level of long fluorescence component, its comparison with the threshold and separation of the concentrating mineral based on comparison results [RU 2235599, C1, B03B 13/06, B07C 5/342, 2004].

This method includes the disadvantage that it is also unsuitable for detecting diamonds with very little or virtually absent SC, since in this case ratio determination is either impossible or leads to a rate of error too high to call for the proposed criteria to be applicable.

As a prototype, we used another known method of mineral segregation based on their fluorescent properties, consisting of the transportation of separated matter, irradiation of that matter with a repetition train of excitation radiation pulses, which are long enough to induce the slow fluorescence component, recording mineral fluorescence signal intensity during each train period, real-time processing of the recorded signal, determination of the concentration criterion value, its comparison with the preset threshold, and recovery of useful mineral from separated matter based on the comparison results [RU 2355483, C2, 2009]. As the concentration criterion, this method uses the combination of three features of the mineral fluorescence signal, a normalized autocorrelation function, the ratio of the total intensity of FC and SC of the signal recorded during the excitation pulse, and intensity of the SC of the signal recorded after the preset end time of the excitation pulse, and the fluorescence decay rate. The fluorescence signal's intensity is recorded in the peak value range that ensures the absence of instrumentation limits for the recorded signal.

The disadvantage of this method is the inability to recover minerals with very little or virtually absent SC, because, in this case the determination of normalized autocorrelation functions, the component ratio and the decay rate is either impossible or produced a rate of error too high for the proposed criterion to work properly.

DISCLOSURE OF INVENTION

This invention technically results in increased selective extraction of concentrating minerals from segregated material.

The technical result will be achieved by the proposed method for the separation of minerals by their fluorescent properties, consisting of segregated material flow transportation, irradiation this material with a repetition train of pulses of excitation radiation with duration sufficient to induce a slow fluorescent component, recording of the mineral fluorescence signal intensity during each train period, real-time processing of the recorded signal, determination of the concentration criterion value, comparing it with the preset threshold and recovery of the concentrating mineral from segregated matter by the comparison results establishing the threshold for the intensity of the fluorescent signal that occurs while the excitation radiation pulse affects the segregated matter and in the preset amount of time after the end of the excitation pulse; at processing of recorded signal, they first determine the fluorescent signal intensity after a preset time after ending of the excitation pulse, compare the findings with the preset threshold, and, in case of threshold elevation, process the signal in order to determine the selected concentration criterion, compare the processing result with the preset threshold and recover the concentrating mineral from the segregated matter, if the comparison result meets the preset criterion, in the event that the resulting value of the fluorescent signal intensity after the preset amount of time after the end of the excitation pulse is less than its threshold, determine the value of the fluorescent signal intensity that occurs during the excitation radiation pulse, compare it with the preset threshold and recover the concentrating mineral from the segregated matter at threshold elevation.

Unlike the traditional method, the proposed method for the separation of minerals based on their fluorescent properties establishes intensity thresholds for the fluorescence signal that occurs during the action of the excitation radiation pulse on the segregated matter and with a preset time delay after the end of the excitation pulse, at the processing of the recorded signal, they first determine the fluorescent signal's intensity during a preset time delay after the end of the excitation pulse, compare the resulting value with the preset threshold, and in case of threshold elevation, they process the signal to determine the value of the selected concentration criterion, compare the processing result with the preset threshold and recover the concentrating mineral from the segregated matter, if the comparison result meets the preset criterion, in the event that the resulting value for the fluorescent signal's intensity after a preset time delay after the end of the excitation pulse is less than its threshold, determine the value of the fluorescent signal intensity that occurs during the excitation radiation pulse, compare it with preset threshold and recover the concentrating mineral from the segregated matter at threshold elevation.

In order to eliminate the influence of time and instrumentation hardware drift changes on the recorded fluorescence signal while its intensity is being determine, it is possible to additionally determine mean average out of minimum fluorescence signal intensities recorded during certain period of time, and to normalize the intensity of fluorescence signal of the segregated matter to this value.

In order to ensure the reliable recording of intensity of the mineral fluorescence signal regardless of its amplitude, it is possible to record the signal simultaneously in several amplitude ranges, i.e. a range with fixed gain factor and ranges with N-fold reduction of gain factor, to determine the range without signal limitation and to process the signal recorded in that range in order to determine the value of the selected concentration criterion.

The combination of features and their relationship with limiting properties in the proposed invention ensure the selectivity and improvement of recovery of concentrating minerals from segregated matter in real time. The combination of actions proposed herein makes it possible to consider both kinetic properties of the concentrating mineral fluorescence signal and natural energy features of various types of material. Specifically, the availability and tracking of energy features in different types of concentrating mineral are predominant for the mineral concentration criterion proposed in this invention. The combination of features also ensures the material separation within on measurement cycle, which not only achieves the technical results, and also ensures high performance and economic efficiency for the segregation process increasing, in its turn, process effectiveness on the following beneficiation stages. The inventive nature of the proposed solution is also confirmed by the fact that such solutions did not appear for at least the last 20 years, in spite of the significance of the problem for the ore-dressing industry. Thus, the proposed engineering solution can truly be considered inventive.

The combination of features and limitations described herein has never been referred to in the studies known to the authors.

BRIEF DESCRIPTION OF THE DRAWINGS

Referring to the FIG. 1 there is illustrated a time chart of recording signals of mineral fluorescence when it is irradiated by the excitation radiation pulses:

a)—excitation pulses;

b)—fluorescence signals recorded without fluorescent minerals;

c)—mineral fluorescence signal having both FC and SC;

d)—mineral fluorescence signal having only FC.

Figure 2:
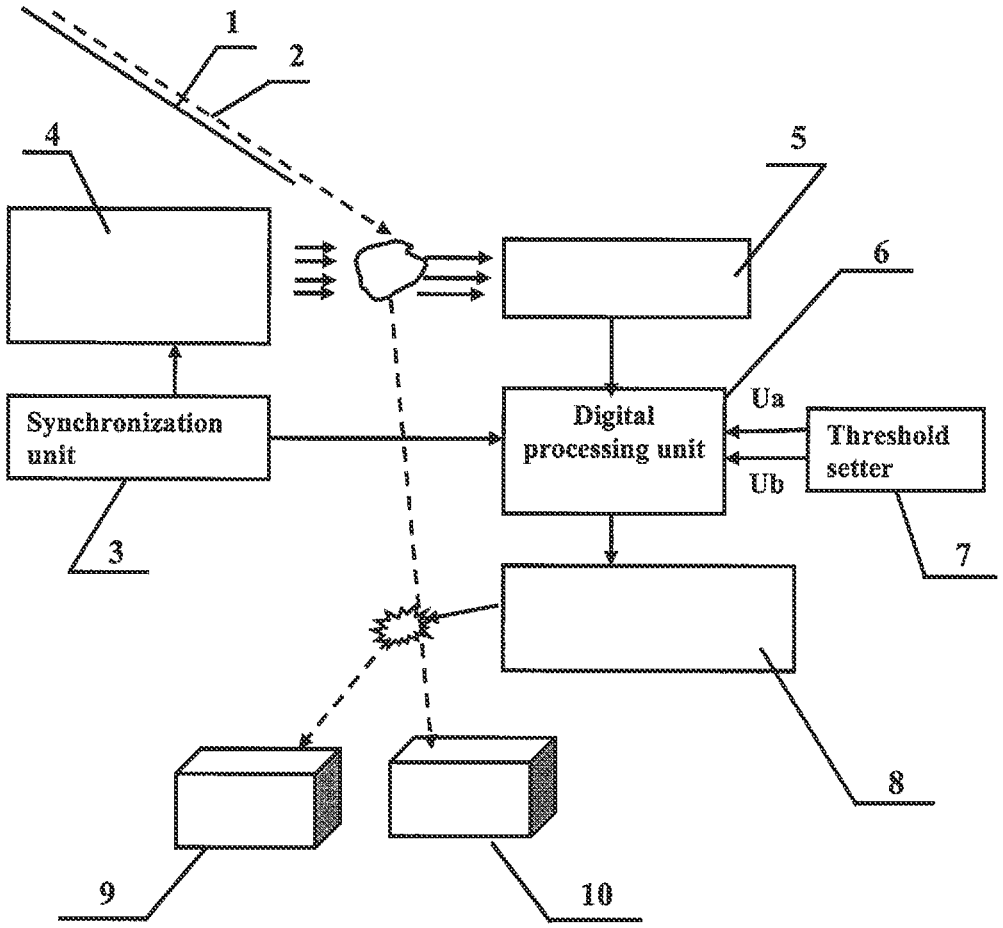

FIG. 2 is a schematic illustration of one of the embodiments of the present invention.

INDUSTRIAL APPLICABILITY

Figure 1:
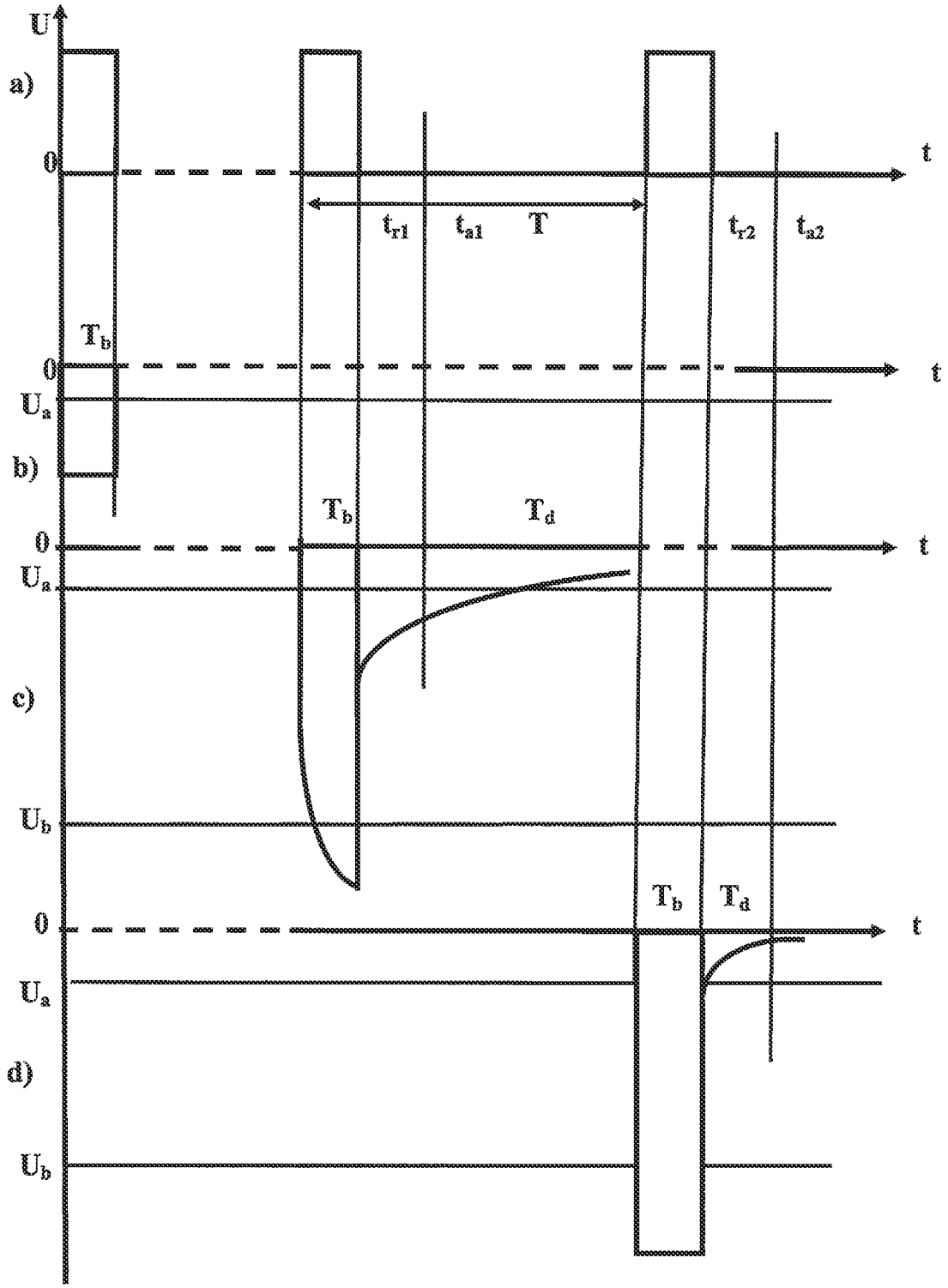

The proposed segregation method of the minerals by their fluorescent properties can be applied as follows. Establish the threshold Ua of intensity of the fluorescence signal U(t) that occurs in a preset time $t_{a1}$ after the end of the excitation radiation pulse (FIG. 1*c*), as well as the threshold Ub of the fluorescence signal U(t) that occurs at time $t_{r1}$ during the excitation radiation pulse action on the segregated matter (FIG. 1*d*). The segregated matter is irradiated with a repetition train of excitation radiation (e.g., X-ray) pulses $t_{r1}$ (FIG. 1*a*), whereas the exposure zone is combined with the recording (inspection) zone. The slow component (SC) of mineral the fluorescence signal U(t) has enough time for complete deexcitation during the irradiation exposure. Record the signal U=f(t) of the mineral fluorescence intensity (FIG. 1*c, d*) in that energy range, where the fluorescence line characteristic for the concentrating mineral is observed with the intensity adequate for recording. The mineral fluorescence can be recorded from the surface of the separated matter with side directed and/or opposite to the irradiation source. The recorded fluorescence signal U(t) can include both segment $T_b$ of deexcitation fast (FC) and slow (SC) components of fluorescence signal and segment $T_d$ of decay of its slow (SC) component (FIG. 1*c*). The recorded signal U(t) may have a segment $T_b$ of deexcitation FC and, possibly, SC of fluorescence signal, and may not have at all the segment $T_d$ of decay of its SC (FIG. 1*d*). Without the fluorescent mineral, recorded signal U(t) is just a segment $T_b$ of deexcitation FC of the air fluorescence (FIG. 1*b*), the shape of which almost follows the shape of excitation radiation pulse, and the intensity is minimum. The fluorescence signal U(t) is recorded during the entire excitation period T (FIG. 1*a*). All recorded signals U(t) are subject to real-time processing. At that, values of air fluorescence signals U(t) are saved during certain period of time to determine its statistically valid mean average value. While processing the fluorescence signals U(t), first determine value of the fluorescence signal U(t) in preset point of time $t_{a1}$ after ending of the excitation radiation pulse $t_{r1}$ and then compare it with preset threshold Ua. If the derived value of signal U(t) is greater than the Ua value, then it is subject to further processing in order to derive the values of the concentration criterion parameters preset for such cases. The derived values of the concentration criterion parameters for signal U(t) are compared with preset thresholds of these parameters, and concentrating mineral is recovered from the segregated matter provided the concentration criterion conditions are met. If the derived value of signal U(t) is not greater than the Ua value, then determine the value of fluorescence signal value U(t) that occurs at time $t_{r1}$ of the action of the excitation radiation pulse. The derived value is compared with threshold Ub, and concentrating mineral is recovered from the segregated matter, if the derived value of signal U(t) is greater than threshold Ub. Thus, the proposed method uses energy features of all kinds of fluorescence minerals for selective separation.

The embodiment of the proposed method is explained in more detail based on the example of the operation of a device for industrial application of proposed invention.

Device (FIG. 2) used to apply the proposed method comprises of the forwarding mechanism 1 made as a gravity slide to transport the flow 2 of segregated matter, synchronization unit 3, pulse excitation radiation source 4, mineral fluorescence photocell 5, digital processing unit 6 for fluorescence signal, threshold setter 7 for the values Ua and Ub of fluorescence signal intensity U(t), actuator 8, receiving bins 9 and 10 respectively for concentrating mineral and tailings.

The forwarding mechanism 1 is intended to transport the flow 2 of segregated matter through exposure-recording zones and cut off under the required speed (for example, under speed 1-3 m/s). Unit 3 is intended to synchronize the required operation sequence of assemblies and units included into device. Source 4 made as an X-ray generator is intended to irradiate flow 2 of segregated matter by continuous train of the excitation radiation pulse. Photocell 5 is intended to convert the mineral fluorescence into an electrical signal. Digital signal processing unit 6 is intended to process the signal from photocell 5, to compare the derived values of fluorescence signal properties with respective preset thresholds and to develop the command for the actuator 8 to separate the concentrating mineral based on the comparison result.

The device (FIG. 2) works as follows. Prior to feeding the matter for processing, synchronization unit 3 is started and issues the excitation pulses of duration sufficient to excite fluorescence SC (for example, 0.5 ms with 4 ms period) to the X-ray generator 4 and digital processing unit 6. The setter 7 enters the numeric values (in voltage units) of thresholds Ua and Ub and values of concentration criterion parameters into unit 6. Then segregating material supply is activated. The gravity slide 1 delivers the flow 2 of segregated matter into the excitation/recording zone, where it is exposed to repetition pulses of duration $t_r$ with period T (FIG. 1*a*) from X-ray generator 4.

Some minerals in segregated matter emit fluorescence under effect of X-ray radiation. Fluorescence signal goes to the photocell 5, which converts the fluorescence signal into the electrical signal that delivers to the processing unit 6. In each period T of the excitation pulse train (FIG. 1*a*), unit 6 records the fluorescence signal, whereas:

if there are no fluorescent minerals in the excitation/recording zone (FIG. 1*b*), the unit 6 records the air fluorescence signal, and, when getting statistically valid amount of such signals, it determines the mean average of the air fluorescence in the excitation/recording zone (the mineral fluorescence characteristics in this case are not determined);

if the excitation/recording zone has a mineral with full fluorescence, and in the preset time $t_{a1}$ the fluorescence level increases the threshold Ua (FIG. 1*c*), processing unit 6 determines such fluorescence signal characteristics specified by the concentration criterion as normalized autocorrelation functions, ratios of components (FC+SC)/SC, constant of the fluorescence decay time after ending of the excitation pulse. After that, processing unit 6 compares the resulting characteristics with preset values in accordance with the identification criterion for the concentrating mineral and, if the comparison result is positive, issues control signal to the actuator 8. Actuator 8 deviate the concentrating mineral into the tailings bin 10. Signal processing in unit 6 by 4 concentration criterion parameters allows to separate the concentrating mineral, for example, from zircon or feldspar, which have intensive fluorescence during action of the excitation pulse;

if the excitation/recording zone has a mineral with intensive fluorescence during the time of action of excitation pulse (FIG. 1*d*), unit 6 is processing such signal and determines absence (less than threshold Ua) of fluorescence in the preset time $t_{a1}$ after the end of the excitation pulse $t_{r1}$, and then compares the signal during action of excitation pulse with the preset threshold Ub.

When determining the value of its intensity, measured signal magnitude U(t) is normalized by mean average of air fluorescence signal.

In addition, if the intensity of the recorded mineral fluorescence is so high that it is greater than input range of the processing unit 6 (signal is limited by amplitude), photocell 5 will provide several outputs: one with available gain, and others with gain N times (10, for instance) less than previous output. Respectively, the processing unit 6 provides several inputs and automatic selection of the right input, where signal is not limited by amplitude.

Synchronization unit 3 and digital signal processing unit 6 can be combined and made based on personal computer or microcontroller. Synchronization unit 3 can be also made as generator of pulses of duration $t_r$ and period T on logical integrated circuits Series K155 or K555, photocell 5 can be made based on photomultiplier tube FEU-85 or R-6094 (Hamamatsu), and processing unit 6—based on microcontroller with a built-in multi-channel analog-to-digital converter. Threshold setter 7 can be made based on a group of switches or numeric keypad connected to the microcontroller. The method of mineral separation by fluorescent properties proposed herein is in compliance with "industrial applicability" criterion.

Preferred Embodiment

Device illustrated on FIG. 2 was tested at the diamond processing plant on diamond imitators (tracers). Blue imitators of Flow Sort were used virtually without fluorescence after ending of the excitation pulse, and imitators of Comeral based on slow phosphor K-35. Both types of tracers were brought into the flow of segregated matter without preliminary tuning of the concentration parameters. Test results demonstrated 100% extraction in both types of imitators.

Thus, the proposed method of mineral separation by the fluorescent properties ensures both extraction of all type of concentrating minerals from the flow of segregated matter and enhances the extraction selectivity.

The invention claimed is:

1. A method for separating minerals by their fluorescent properties, comprising the steps of:

irradiating material in a segregated material flow with a plurality of pulses of excitation radiation sufficient to excite a slow fluorescent component of the material, recording a signal representing an intensity of the mineral fluorescence signal during the plurality of pulses of excitation radiation and during a period of time after a preset time after irradiation of the material so as to measure both fast and slow components of mineral luminescence of the material, determining a concentration criterion value of the material using the signal and comparing the concentration criterion value with a first preset threshold for use during excitation of the material and comparing the concentration criterion with a second preset threshold for use a preset time after the end of excitation of the material, and separating and recovery of minerals from the material when the concentration criteria exceeds the first preset threshold during excitation of the material, separating and recovery of minerals from the material when the concentration criteria exceeds the second preset threshold after the preset time after the end of excitation of the material by the plurality of pulses.

2. The method of claim 1, wherein the step of determining the concentration criterion value comprises determination of a mean average value of intensity of the signal recorded during a predetermined period of time, and normalization of the fluorescence signal intensity to that value.

3. The method of claim 1, wherein the step of recording the signal comprises recording the fluorescence signal simultaneously in several amplitude ranges such that the signal is recorded simultaneously over a range with fixed gain factor, and in ranges with N-fold reduction of gain factor, determining range without signal limitation, and processing of the signal recorded in that range in order to determine the value of the selected concentration criterion.

* * * * *